US006923880B2

(12) United States Patent
Keene et al.

(10) Patent No.: US 6,923,880 B2
(45) Date of Patent: Aug. 2, 2005

(54) FILM SPLICER APPARATUS AND METHOD FOR SPLICING A FILM USED FOR BAGGING SNACK FOODS

(75) Inventors: John F. Keene, Durand, IL (US); Christopher J. Plude, Beloit, WI (US)

(73) Assignee: Keene Technology Inc.,, South Beloit, IL (US)

( * ) Notice: Subject to any disclaimer, the term of this patent is extended or adjusted under 35 U.S.C. 154(b) by 0 days.

(21) Appl. No.: 10/299,280

(22) Filed: Nov. 19, 2002

(65) Prior Publication Data

US 2004/0112527 A1 Jun. 17, 2004

(51) Int. Cl.[7] ..... B65H 69/06; B65H 21/00

(52) U.S. Cl. ..... 156/159; 156/502; 156/504; 242/553; 242/554.5; 242/556

(58) Field of Search ..... 156/157, 159, 156/502, 504, 505; 242/551, 552, 553, 554.5, 556

(56) References Cited

U.S. PATENT DOCUMENTS

| | | | | | |
|---|---|---|---|---|---|
| 3,939,032 | A | * | 2/1976 | Taitel et al. | 156/505 |
| RE29,365 | E | * | 8/1977 | Butler Jr. | 242/552 |
| 4,067,760 | A | * | 1/1978 | Nelson | 156/157 |
| 4,157,934 | A | * | 6/1979 | Ryan et al. | 156/504 |
| 4,390,388 | A | * | 6/1983 | Nagata et al. | 156/351 |
| 4,481,053 | A | * | 11/1984 | Tokuno et al. | 156/157 |
| 4,566,922 | A | * | 1/1986 | Martinez | 156/64 |
| 5,388,387 | A | * | 2/1995 | McElvy | 53/451 |
| 5,514,237 | A | * | 5/1996 | Emenaker et al. | 156/159 |
| 5,669,998 | A | * | 9/1997 | Ward et al. | 156/159 |
| 5,853,141 | A | * | 12/1998 | Heiber et al. | 242/552 |
| 6,192,955 | B1 | * | 2/2001 | Rice | 156/351 |
| 6,328,088 | B1 | * | 12/2001 | Draghetti | 156/504 |
| 6,397,915 | B1 | * | 6/2002 | Amaranti et al. | 156/504 |
| 6,451,145 | B1 | * | 9/2002 | Forbes | 156/159 |
| 6,500,288 | B2 | * | 12/2002 | Hara et al. | 156/159 |
| 2002/0046812 | A1 | * | 4/2002 | Muller et al. | 156/507 |

* cited by examiner

*Primary Examiner*—Mark A. Osele
(74) *Attorney, Agent, or Firm*—David J. Archer

(57) ABSTRACT

A film splicer apparatus is disclosed for splicing a film used for bagging snack foods. The apparatus includes a frame and an axle which is rotatably supported by the frame for rotatably supporting a first roll of the film used for the bagging of the snack foods. A further axle is disposed spaced from the axle for rotatably supporting a replacement second roll of film for replacing the first roll of the film when spent. The first roll and the replacement second roll are rotatable about a first and second axis respectively, the first and second axes being disposed spaced and parallel relative to each other. A tail grabber is provided for grabbing a tail end of the spent first roll. Also, a tracking control is used for tracking the tail end of the spent first roll. A registration device is controlled by the tracking control for registering the tail end of the first roll with an aligned leading edge of the replacement second roll. Additionally, a splice head splices together the registered tail end and the leading edge such that the replacement roll is brought into operation without stopping the operation of bagging the snack foods.

20 Claims, 6 Drawing Sheets

FILM SPLICER APPARATUS AND METHOD FOR SPLICING A FILM USED FOR BAGGING SNACK FOODS

BACKGROUND OF THE INVENTION

1. Field of the Invention

The present invention relates to a film splicer apparatus and method. More particularly, the present invention relates to a film splicer apparatus for splicing a film used for bagging snack foods.

2. Background Information

In the food packaging industry, printed plastic film is used for packaging various food items. For example, potato chips and the like are heat sealed within an envelope which is formed from a folded heat sealed plastic film. The heat sealed film is guided towards the food dispensing and packaging station from a roll of such film.

However, when the roll of film has been depleted, an operator has typically stopped the packaging line while a replacement roll is installed. Such stopping of the packaging process causes a costly lack of production.

Also, in the known packaging arrangements, the operator has often replaced the depleted roll without using all the film therefrom. Consequently, many potential packages are not utilized thus further increasing the cost of production.

The apparatus according to the present invention overcomes the aforementioned problems by enabling an operator to prepare a replacement roll of film prior to the depletion of the running roll so that when the tail end of the depleted roll is sensed, a leading edge of the replacement roll can be spliced thereto without stopping the packaging line.

Furthermore, the apparatus, according to the present invention, enables the operator to use all of the film from the depleted roll because the splicing operation is actuated in response to an absence of rotation of the core of the depleted roll.

Therefore, it is a primary feature of the present invention to provide a film splicer apparatus for splicing a film used for bagging snack foods that overcomes the problems associated with the prior art arrangements.

Another feature of the present invention is the provision of a film splicer apparatus for splicing a film used for bagging snack foods that enables continuous packaging during roll replacement.

A further feature of the present invention is the provision of a film splicer apparatus for splicing a film used for bagging snack foods that enables an operator to use all of the film on a depleted roll.

Other features and advantages of the present invention will be readily apparent to those skilled in the art by a consideration of the detailed description of a preferred embodiment of the present invention contained herein.

SUMMARY OF THE INVENTION

The present invention relates to a film splicer apparatus for splicing a film used for bagging snack foods and the like. The apparatus includes a frame and an axle which is rotatably supported by the frame for rotatably supporting a first roll of the film used for the bagging of the snack foods. A further axle is disposed spaced from the axle for rotatably supporting a replacement second roll of film for replacing the first roll of the film when spent. The first roll and the replacement second roll are rotatable about a first and second axis respectively, the first and second axes of the rolls being disposed spaced and parallel relative to each other. A tail grabber is provided for grabbing a tail end of the spent first roll. A driven drive roll is disposed downstream relative to the tail grabber for pulling the film through the tail grabber. Also, a registration device is provided for registration of the tail end of the first roll with an aligned leading edge of the replacement second roll. A splice head is used for splicing together the registered tail end and the leading edge such that the replacement roll is brought into operation without stopping the operation of bagging the snack foods.

In a more specific embodiment of the present invention, the axle cooperates with a core of the first roll of the film. Also, the first and second axes are disposed horizontally.

Moreover, the tail grabber includes a first roller for guiding the tail end and a clamp which is movable from a first location thereof spaced from the first roller to a second location thereof in which the tail end is clamped between the clamp and the first roller. The arrangement is such that limited movement of the tail end relative to the first roller is permitted so that controlled registration of the tail end is attainable.

In a preferred embodiment of the present invention, the tail grabber further includes a second roller for guiding the tail end. More specifically, the clamp is movable from the first location thereof spaced from the first and second rollers to a second location thereof in which the tail end is clamped between the clamp and the first and second rollers. The arrangement is structured such that limited movement of the tail end relative to the first and second rollers is permitted so that controlled registration of the tail end is attainable.

Additionally, the tail grabber further includes a third roller which is disposed downstream relative to the first roller and upstream relative to the second roller. The rollers are arranged such that the tail end is guided around the first roller and is then guided around the third roller and is then guided back around the second roller so that the tail end follows a sinuous path.

Furthermore, the axle cooperates with a core of the first roll of the film and the tail grabber is actuated in response to an absence of rotation of the core of the first roll of the film.

Moreover, the tail grabber moves from the first location thereof to the second location thereof in response to the absence of rotation of the core of the first roll so that when the first roll of the film is spent, the empty core stops rotating. A sensor is provided for sensing the absence of rotation of the core of the first roll. Consequently, the sensor generates a signal responsive to the sensed absence of rotation of the core of the first roll and the signal triggers actuation of the tail grabber so that the tail grabber moves to the second location thereof for slidably grabbing the tail end of the first roll of film.

The film splicer apparatus also includes a backing roller which cooperates with the drive roll to define therebetween a nip for the passage therethrough of the film such that when the drive roll is driven, the film is pulled by an interaction of the drive roll and the backing roller until the tail end of the spent first roll is disposed in registration with and aligned relative to the leading edge of the replacement second roll.

The film splicer apparatus further includes a festoon which is disposed downstream relative to the drive roll. The drive roll pulls the film from the first roll and feeds the film into the festoon.

A control system is provided for controlling the drive roll. The control system includes a position encoder for monitoring a position of the festoon. The position encoder emits a signal dependent on a position of the festoon, the signal controlling a rotational speed of the driye roll so that the position of the festoon is maintained in equilibrium.

A splice position tracking mechanism is provided for tracking a position of a splice that has been generated at the splice head. The tracking mechanism includes a sensor for sensing the location of the splice and for alerting a downstream bagging station of the approach of such splice so that filling at a spliced bag can be avoided.

The encoder monitors a position of the festoon during the splicing so that determination of a distance travelled by the splice from the splice to the bagging station is permitted.

The tracking mechanism counts encoder pulses from the sensor to determine when the splice has travelled to the bagging station so that bagging of the snack foods can be inhibited such that wastage of snack foods can be minimized.

Additionally, the registration device includes a first module which includes a first guide roll and a second guide roll which is disposed down stream relative to the first guide roll. The guide rolls are arranged such that the guide rolls guide the tail end from the tail grabber. Also, a pivot is provided for pivoting the first module relative to the leading edge of the replacement second roll.

Also, the registration device further includes a second module. The second module includes a first guiding roll and a second guiding roll which is disposed down stream relative to the first guiding roll such that the guiding rolls guide the leading edge from the second roll. A further pivot is provided for pivoting the second module relative to the tail end of the first roll. The arrangement is structured such that the leading edge of the replacement second roll is prepared by pivoting the second module away from the first roll and positioning the leading edge such that when the second module is pivoted back towards the first roll, the film of the first roll is disposed between the first module and the second module.

The splice head includes a heat sealing device for heat sealing the registered tail end of the first roll to the leading edge of the replacement second roll. More specifically, the heat sealing device is a lap splicer.

Furthermore, the heat sealing device includes a device for pressing the tail end against the leading edge when registered or indexed relative to each other. Also, a heating element is provided. The heating element is activated when the tail end and the leading edge are in registration relative to each other so that the tail end and the leading edge are fused together for sealing thereof. The device releases the spliced tail end and leading edge when the splice has cooled.

Additionally, the splice head further includes a knife for cutting off a trailing end of the tail end of the first roll when the tail end has been sealed to the leading edge of the replacement second roll.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

BRIEF DESCRIPTION OF THE DRAWINGS

Similar reference characters refer to similar parts throughout the various views and embodiments of the drawings.

DETAILED DESCRIPTION OF THE DRAWINGS

Figure 1:
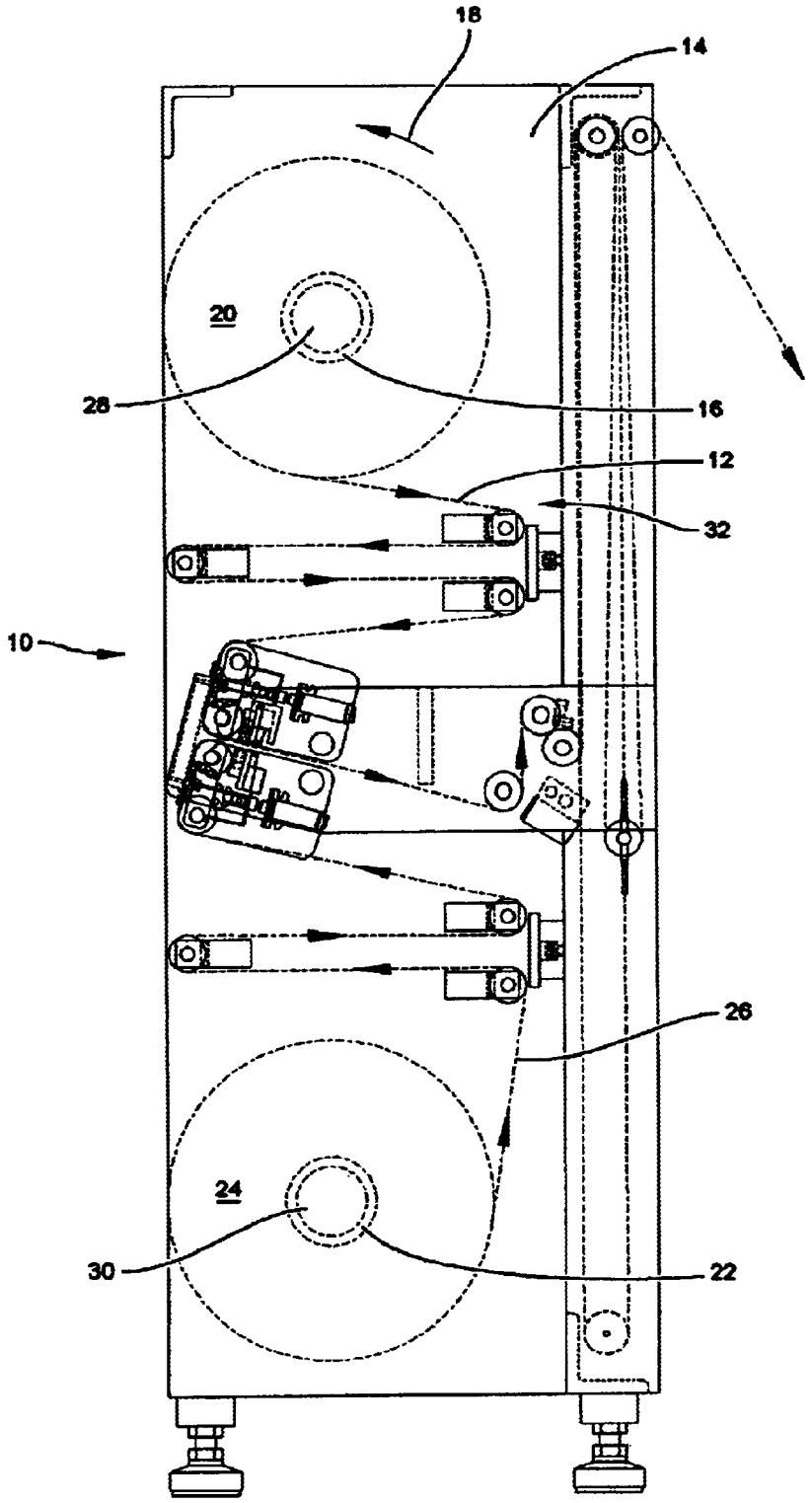
FIG. 1 is a side elevational view of a film splicer apparatus according to the present invention for splicing a film used for bagging snack foods.

FIG. 1 is a side elevational view of a film splicer apparatus generally designated 10 according to the present invention for splicing a film 12 used for bagging snack foods. As shown in FIG. 1, the apparatus 10 includes a frame 14 and an axle 16 which is rotatably supported as indicated by the arrow 18, by the frame 14 for rotatably supporting a first roll 20 of the film 12 used for the bagging of the snack foods. A further axle 22 is disposed spaced from the axle 16 for rotatably supporting a replacement second roll 24 of film 26 for replacing the first roll 20 of the film 12 when spent. The first roll 20 and the replacement second roll 24 are rotatable about a first and second axis 28 and 30 respectively, the first and second axes 28 and 30 being disposed spaced and parallel relative to each other.

Figure 2:
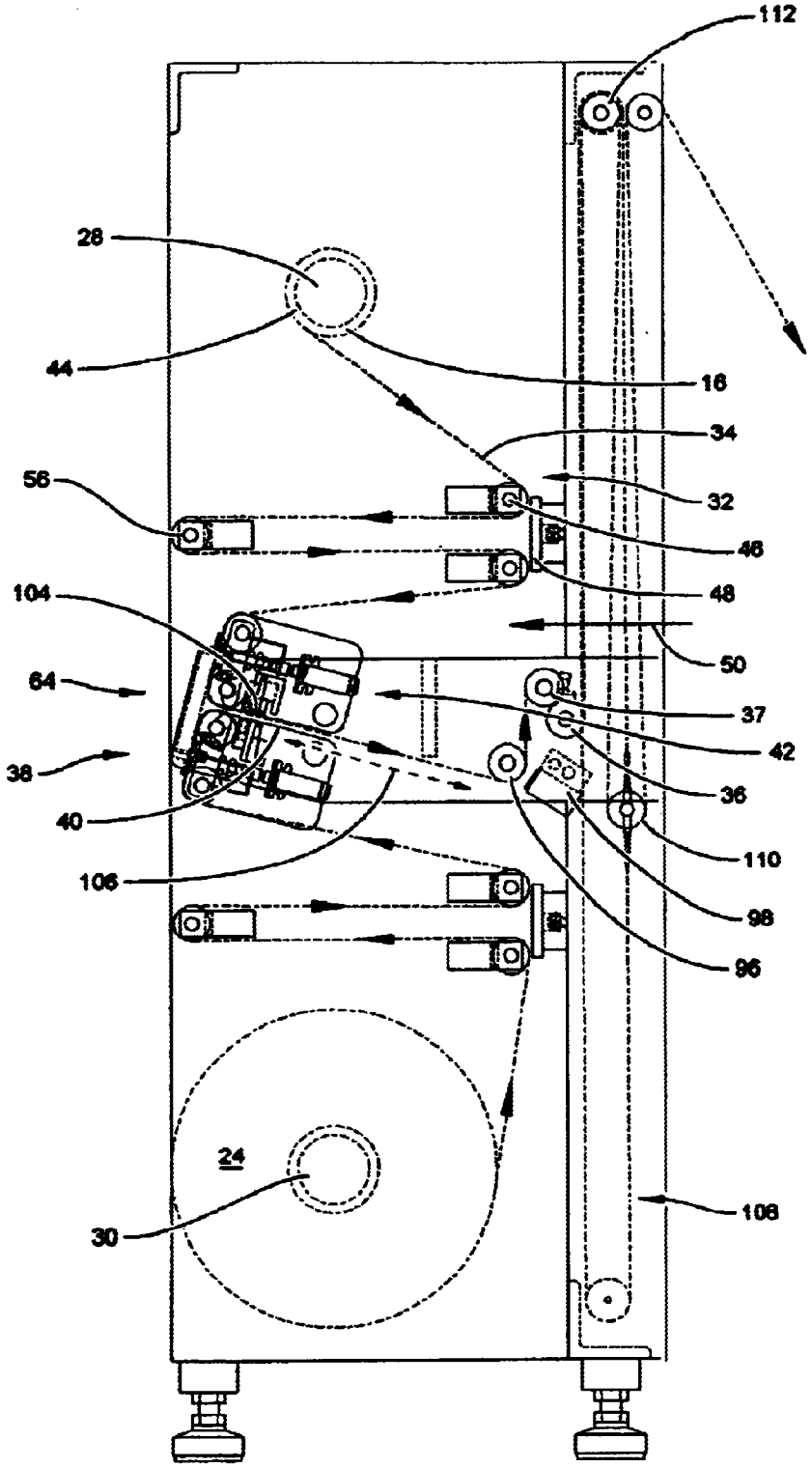
FIG. 2 is a similar view to that shown in FIG. 1 but shows the first roll of film depleted.

FIG. 2 is a similar view to that shown in FIG. 1 but shows the first roll 20 of film 12 depleted. As shown in FIG. 2, a tail grabber generally designated 32 is provided for grabbing a tail end 34 of the spent first roll 20. A driven drive roll 36 is disposed downstream relative to the tail grabber 32 for pulling the film 12 through the tail grabber 32.

Also as shown in FIG. 2, a backing roller 37 cooperates with the drive roll 36 to define therebetween a nip for the passage therethrough of the film 12. The arrangement is such that when the drive roll 36 is driven, the film 12 is pulled by an interaction of the drive roll 36 and the backing roller 37 until the tail end 34 of the spent first roll 20 is disposed in registration with and aligned relative to an leading edge 40 of the replacement second roll 24.

A registration device 38 is provided for registration of the tail end 34 of the first roll 20 with the aligned leading edge 40 of the replacement second roll 24. A splice head 42 is used for splicing together the registered tail end 34 and the leading edge 40 such that the replacement roll 24 is brought into operation without stopping the operation of bagging the snack foods.

In a more specific embodiment of the present invention, the axle 16 cooperates with a core 44 of the first roll 20 of the film 12. Also, the first and second axes 28 and 30 respectively are disposed horizontally.

Moreover, the tail grabber 32 includes a first roller 46 for guiding the tail end 34 and a clamp 48 which is movable as indicated by the arrow 50 from a first location thereof spaced from the first roller 46.

Figure 3:
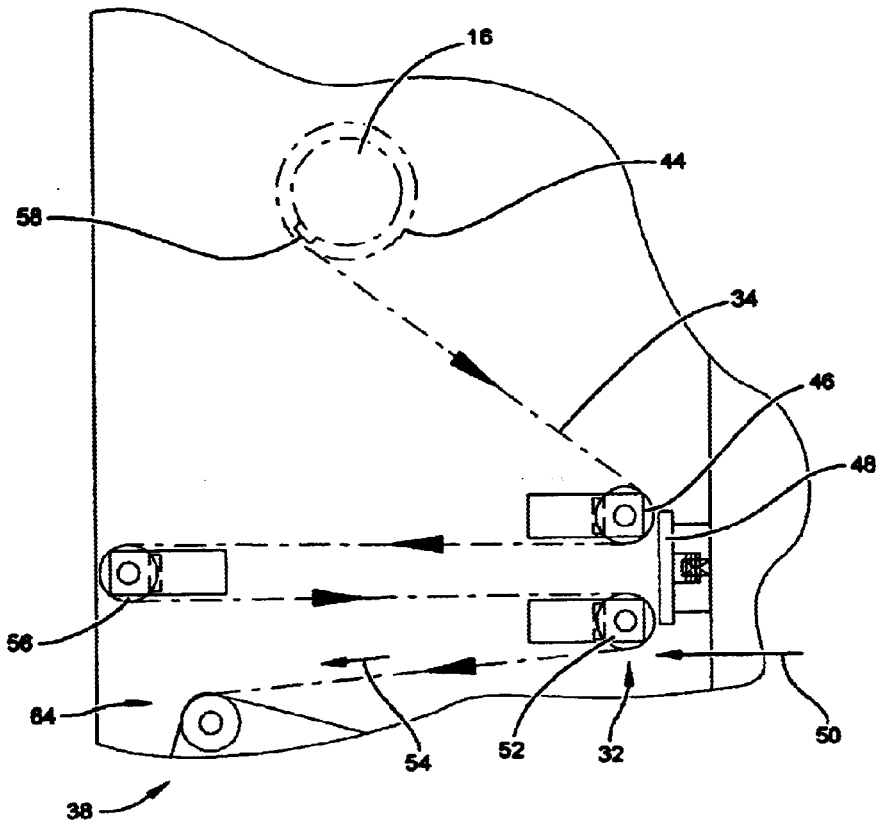
FIG. 3 is an enlarged view of the tail grabber shown in FIG. 2 but shows the tail grabber having moved to a second location thereof in which the tail end is clamped between the clamp and the first roller.

FIG. 3 is an enlarged fragmentary view of the tail grabber 32 shown in FIG. 2 but shows the tail grabber 32 having moved to a second location thereof in which the tail end 34 is clamped between the clamp 48 and the first roller 46. The arrangement is such that limited movement of the tail end 34 relative to the first roller 46 is permitted so that controlled registration of the tail end 34 is attainable. More specifically, when the clamp 48 is clamped against the roller 46, the tail end 34 of the film 12 is controllably dragged by a drive so that the tail end 34 may be aligned and indexed or registered relative to the preprepared leading edge 40 of the replacement second roll 24.

In a preferred embodiment of the present invention, the tail grabber 32 further includes a second roller 52 for guiding the tail end 34. More specifically, the clamp 48 is movable as indicated by the arrow 50 from the first location thereof spaced from the first and second rollers 46 and 52, as shown in FIGS. 1 and 2, to a second location thereof as shown in FIG. 3, in which the tail end 34 is clamped between the clamp 48 and the first and second rollers 46 and 52. The arrangement is structured such that limited movement of the tail end 34, as indicated by the arrow 54, relative to the first and second rollers 46 and 52 respectively is permitted so that controlled registration of the tail end 34 relative to the leading edge 40 is attainable.

Additionally, the tail grabber 32 further includes a third roller 56 which is disposed downstream relative to the first roller 46 and upstream relative to the second roller 52. The rollers 46, 52 and 56 are arranged such that the tail end 34 is guided around the first roller 46 and is then guided around the third roller 56 and is then guided back around the second roller 52 so that the tail end 34 follows a sinuous path.

Furthermore, the axle 16 cooperates with the core 44 of the first roll 20 of the film 12 and the tail grabber 32 is actuated in response to an absence of rotation of the core 44 of the first roll 20 of the film 12.

Moreover, the tail grabber 32 moves as indicated by the arrow 50 from the first location thereof as shown in FIGS. 1 and 2, to the second location thereof as shown in FIG. 3 in response to the absence of rotation of the core 44 of the first roll 20 so that when the first roll 20 of the film 12 is spent as shown in FIG. 3, the empty core 44 stops rotating. A sensor 58 is provided for sensing the absence of rotation of the core 44 of the first roll 20. Consequently, the sensor 58 generates a signal responsive to the sensed absence of rotation of the core 44 of the first roll 20 and the signal triggers actuation of the tail grabber 32 so that the tail grabber 32 moves as indicated by the arrow 50 to the second location thereof shown in FIG. 3 for slidably grabbing the tail end 34 of the first roll 20 of the film 12.

Additionally, the registration device 38 includes a first module generally designated 64.

Figure 4:
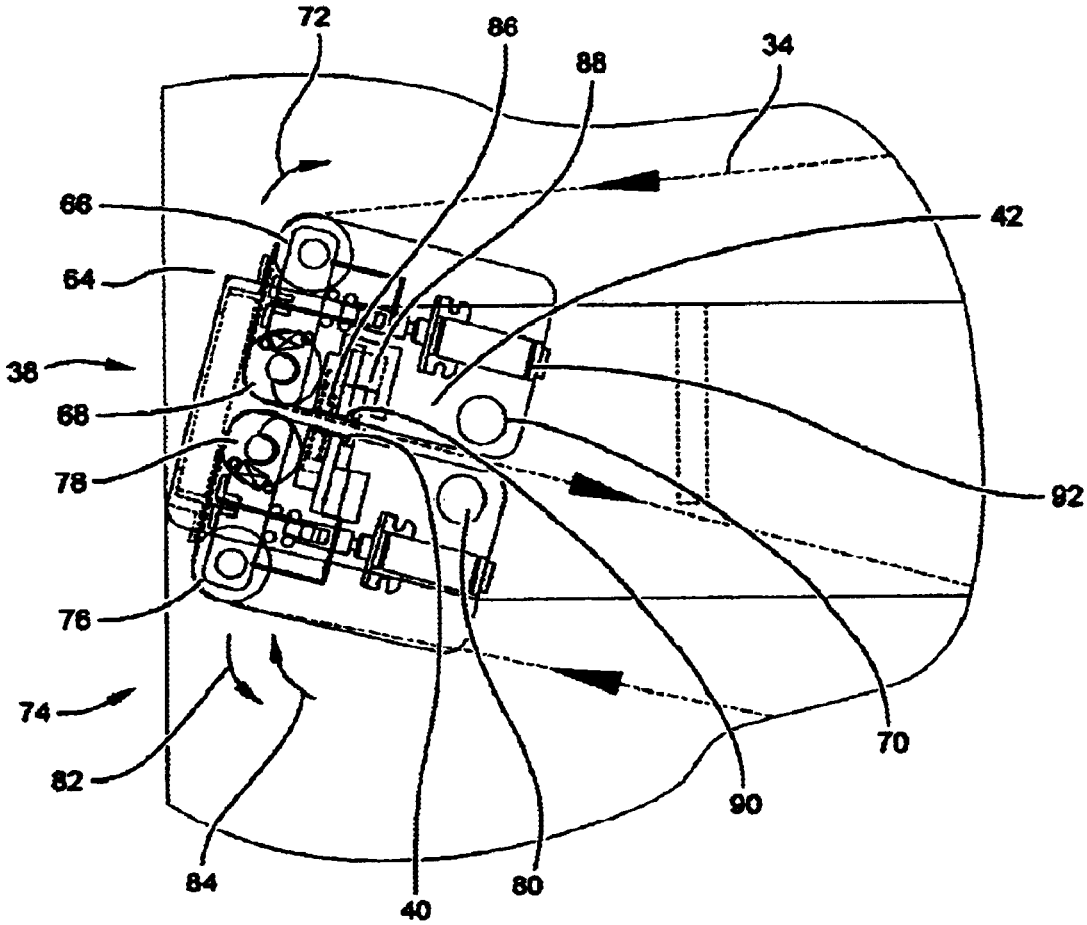
FIG. 4 is an enlarged view of the first module.

FIG. 4 is an enlarged view of the first module 64. As shown in FIG. 4, the first module 64 includes a first guide roll 66 and a second guide roll 68 which is disposed down stream relative to the first guide roll 66. The guide rolls 66 and 68 are arranged such that the guide rolls 66 and 68 guide the tail end 34 from the tail grabber 32. Also, a pivot 70 is provided for pivoting the first module 64 relative to the leading edge 40 of the replacement second roll 24 as indicated by the arrow 72.

Also, the registration device 38 further includes a second module generally designated 74. The second module 74 includes a first guiding roll 76 and a second guiding roll 78 which is disposed down stream relative to the first guiding roll 76 such that the guiding rolls 76 and 78 respectively guide the leading edge 40 from the second roll 24. A further pivot 80 is provided for pivoting the second module 74 relative to the tail end 34 of the first roll 20. The arrangement is structured such that the leading edge 40 of the replacement second roll 24 is prepared by pivoting the second module 74 away from the first roll 20 as indicated by the arrow 82 and positioning the leading edge 40 such that when the second module 74 is pivoted back towards the first roll 20 as indicated by the arrow 84, the film 12 of the first roll 20 is disposed between the first module 64 and the second module 74 with the leading edge 40 disposed between the second module 74 and the tail end 34.

As shown in FIG. 4, the splice head 42 includes a heat sealing device generally designated 86 for heat sealing the registered tail end 34 of the first roll 20 to the leading edge 40 of the replacement second roll 24. More specifically, the heat sealing device 86 is a lap splicer for splicing the tail end 34 under or over the leading edge 40.

Furthermore, the heat sealing device 86 includes a device 88 for pressing the tail end 34 against the leading edge 40 when registered or indexed. Also, a heating element 90 is provided. The heating element 90 is energized when the tail end 34 and the leading edge 40 are correctly registered or indexed relative to each other so that the tail end 34 and the leading edge 40 are fused together for sealing thereof. The device 88 releases the spliced tail end 34 and leading edge 40 when the splice has cooled.

Additionally, the splice head 42 further includes a knife 92 for cutting off a trailing end (not shown) of the tail end 34 of the first roll 20 when the tail end 34 has been sealed to the leading edge 40 of the replacement second roll 24.

In operation of the apparatus 10, the first and second rolls 20 and 24 are loaded and the film 12 is threaded around rollers 46, 56 and 52 respectively and then around guide rolls 66 and 68 when the first module 64 is pivoted away from the second roll 24 as indicated by the arrow 72. The film 12 is then threaded through the drive 36 and around a downstream festoon and onto the filling and packaging station. The first module 64 is then pivoted back to the disposition thereof shown in FIG. 4. The apparatus 10 is then ready for operation and the film 12 is pulled from the first roll 20 by the drive 36 which may include a drive roller and a backing roller defining a nip therebetween for the passage therethrough of the film 12.

During the supply of film from the first roll 20, the operator winds the leading edge 40 of the replacement second roll 24 through a series of rollers which are identical in reverse to the rollers 46, 56, and 52 and around the guiding rollers 76 and 78 when the second module 74 is pivoted away from the running film 12 as indicated by the arrow 82 shown in FIG. 4. The operator cuts the leading edge to provide a square edge to the leading edge. Such squared edge is attached to the second module by double sided adhesive tape or the like. The second module 74 is then pivoted to the disposition thereof shown in FIG. 4.

When the first roll 20 is depleted, the tail end 34 of the film will be pulled away from the core 44 by the drive 36. Consequently, the core 44 will stop rotating because the axle 16 is a free running axle. The sensor 58 will sense that the core 44 has stopped rotating and the sensor 58 will trigger the tail grabber 32 so that the tail end 34 will be restrained by the tail grabber 32 so that a certain amount of tension is retained along the tail end 34 between the roller 46 and the drive 36. When the tail end 34 is correctly indexed relative to the stationary leading edge 40, the device 88 urges the indexed tail end 34 against the leading edge 40 and the heating element 90 fuses the registered tail end 34 and leading edge 40 together. When the heat sealed tail end 34 and leading edge 40 have cooled down, the device 88 releases the fused tail end 34 and leading edge 40 and the knife 92 moves laterally across the spliced films to remove therefrom the trailing end of the tail end 34. During the heat sealing operation, the rotation of the drive 36 is momentarily interrupted. Subsequently, the supply of film is provided from the replacement roll 24.

Furthermore, the axle 16 is subsequently loaded with a replacement roll in order to replace the roll 24 when depleted. The leading edge is prepared as before with regard to the leading edge 40. However, the leading edge will be prepared on the first module 64. In this manner, the supply of bags at the filling and sealing station remains uninterrupted thus increasing production and greatly reducing packaging costs because of the avoidance of any wastage of film at the end of a roll of film.

More specifically, as shown in FIG. 2, the film 12 is guided around a guiding roller 96. A sensor 98 is disposed adjacent to roller % for sensing and generating a pulse every time a reference point on the film 12 passes the sensor 98. For example, in a typical roll 20 of film, the reference point will be located at the juncture between adjacent bags. Therefore, if for example the resultant bag is 5" in length, the reference point will be spaced 5" from an adjacent reference point. Consequently, when the apparatus 10 is running, if the sensor 98 senses 14 pulses per second, this means that the film 12 is travelling at a speed of 14 times 5" per second or 70" per second.

Moreover, the travel distance between the sensor 98 and the point of splice 104 is a fixed and non variable length 106 as shown in FIG. 2. If for example, the length 106 were 13", then the time taken for the film 12 adjacent to the point of splice 104 to travel to the sensor 98 would be 13/70 seconds. However, in the 13' length 106, there would be 13/5 or 2.6 bags. Therefore, when a splice is to be made, the drive roll 36 is not stopped 13/70 seconds after a pulse is sensed but rather 13/70 seconds plus the time taken for the remaining 0.4 of the bag to reach the point of splice 104 thus representing a total length of 3 bags or 15". The additional time taken for the travel of the 0.4 bag can be calculated because the speed of 70" per second is known. Consequently the time taken for the travel of the 3 bags totalling 15" would be 15"/70" seconds. Therefore, according to the present invention, the splice is applied preferably between adjacent bags in order to maintain correct and accurate registration thereof. However, if required, the splice could be applied at any point along a length of the bag. Also, the timing of the application of the splice can be coordinated and calculated automatically given the length of the bag being used and knowing the distance of the reference point from the juncture of adjacent bags if this distance is not zero. Additionally, such splicing calculation can be made when the apparatus is operating at a different film speed. Such measured film speed will be used in the calculation of the time delay from a pulse to the stopping of the drive roll 36 and the simultaneous application of the splice.

After the application of the splice, the drive roll 36 is again rotated to feed the splice through a downstream festoon generally designated 108. However, when the splice is applied, the drive roll 36 stops. Although the drive roll 36 stops and the film upstream thereof stops moving, the film 12 downstream from the drive roll 36 is still being intermittently pulled towards the bagging and filling station so that production continues without interruption. In order to accommodate such downstream movement of the film, a dancer roll of the festoon 108 momentarily rises in order to accomodate the supply demanded by the bagging station when the drive roll 36 is stopped.

Figure 8:
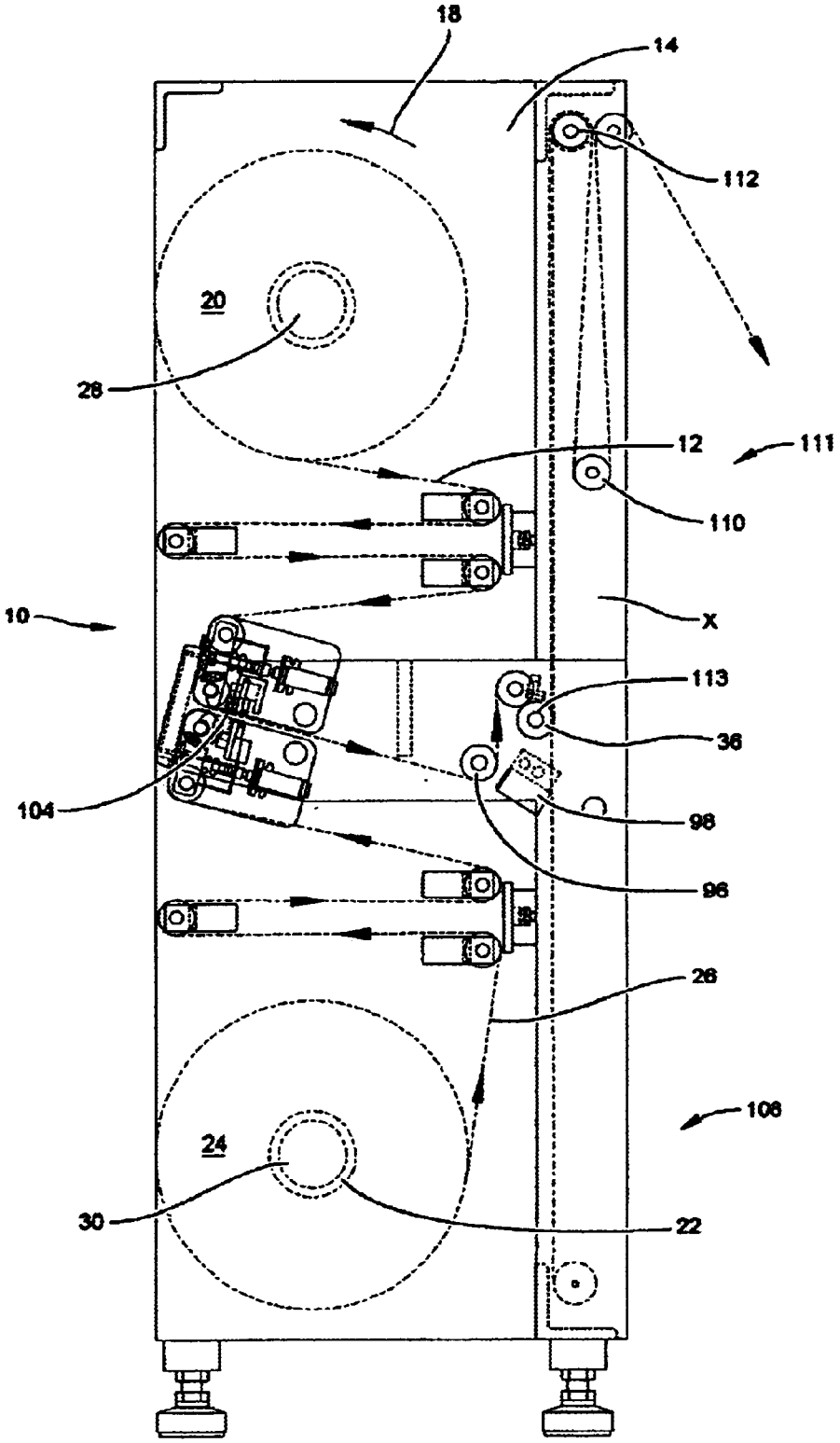
FIG. 8 is a schematic view showing the path of a splice from a point of splice to a bagging station immediately following a splice.

FIG. 8 is a schematic showing a path of the splice from the point of splice 104 to a bagging station 111. As shown in FIG. 8, a further sensor 112 measures such upward distance x travelled by the dancer roll 110. Consequently, when the splice has been applied and the drive roll 36 is again rotated, the dancer roll 110 will drop to an original location thereof as shown in FIG. 2 and will subsequently be maintained in approximately that location of equilibrium until the application of the next splice. A control system is provided for controlling the drive roll 36. The control system includes a position encoder for monitoring a position of the festoon 108. The position encoder emits a signal dependent on a position of the festoon 108, the signal controlling a rotational speed of the drive roll 36 so that the position of the festoon 108 is adjusted, so as to fill a depleted festoon such that the equilibrium position is reached.

When the drive roll 36 starts to rotate after a splice, the time taken for the splice to travel from the point of splice 104 to the sensor 98 can be easily calculated by counting the pulses per second. Also, the distance between the sensor 98 and the bagging station 111 when the dancer roll 110 is in the lower equilibrium location is known. Consequently, by subtracting the distance 2 times x from the distance from the sensor 98 to the bagging station 11 shown in FIG. 2, the actual distance travelled by the splice from the sensor 98 towards the bagging station 111 can be calculated for a given time. Also, the time taken from the splicing operation until the splice reaches the bagging station 111 can be calculated. Such information can be used by a bagging operator in order to avoid filling a spliced bag.

Figure 5:
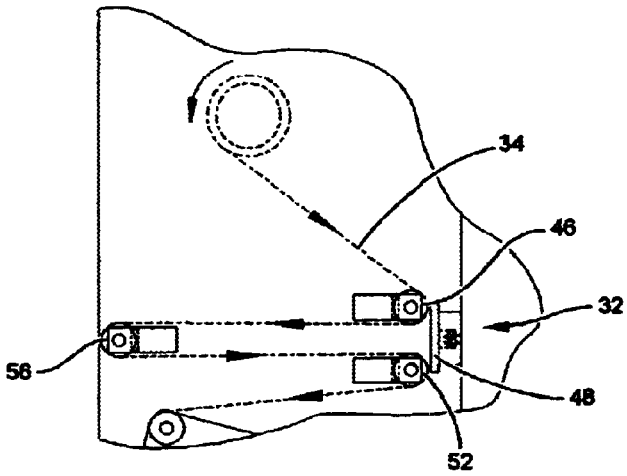
FIG. 5 is a view of the tail grabber shown in FIG. 3 with the tail end of the film threaded in a first configuration thereof.
Figure 6:
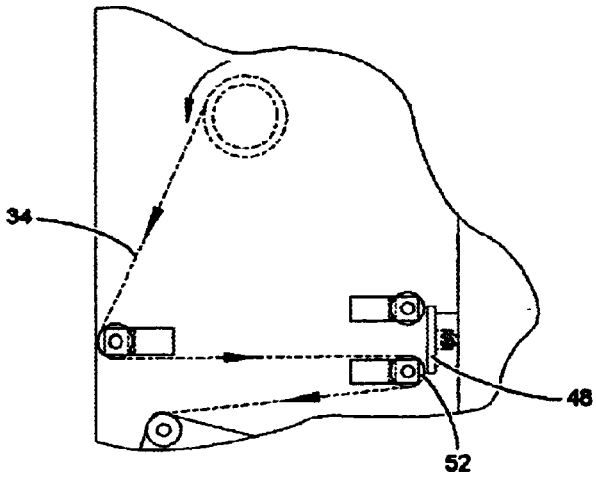
FIG. 6 is a view of the tail grabber shown in FIG. 3 with the tail end of the film threaded in a second configuration thereof.
Figure 7:
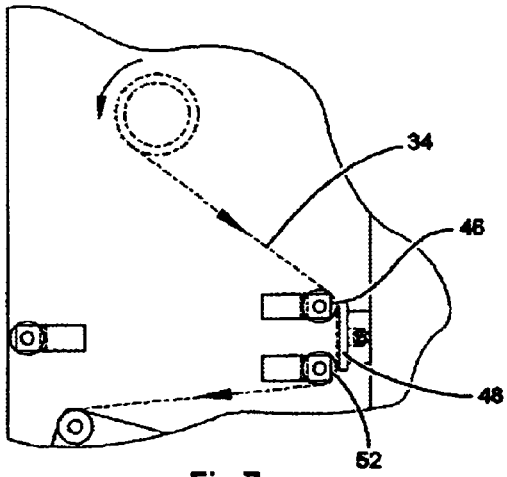
FIG. 7 is a view of the tail grabber shown in FIG. 3 with the tail end of the film threaded in a third configuration thereof.

By the provision of the alternative paths of travel of the tail end 34 of the film 12 from the spent roll 20 to the point of splice 104, different sized bags can be accommodated. For example, if a roll of long bags is to be spliced and each bag has a length of 20", the configuration shown in FIG. 5 will be employed. In this case, the distance between the first roller 46 and the point of splice 104 will be considerably more than 20". However, if a bag having a length of for example 12" is being used, the arrangement shown in FIG. 6 may be used. As shown in FIG. 6, the distance between the second roller 52 of the tail grabber 32 is less than in the case of the arrangement shown in FIG. 5. Nevertheless, the distance between roller 52 and the point of splice 104 is still grater than 12". FIG. 7 shows a third configuration for other applications in which more restraint by the tail grabber 32 is required. As shown in FIG. 7, the tail end 34 is pinched between both rollers 46 and 52 and the clamp 48.

Accordingly, the present invention provides a unique apparatus which permits continuous operation of a packaging line while reducing wastage of packaging film when a roll becomes depleted.

What is claimed is:

1. A film splicer apparatus for splicing a film used for bagging snack foods, said apparatus comprising:

a frame;

an axle supported by said frame for rotatably supporting a first roll of the film used for the bagging of the snack foods;

a further axle disposed spaced from said axle for rotatably supporting a replacement second roll of film for replacing the first roll of the film when spent, the first roll and the replacement second roll being rotatable about a first and second axis respectively, said axes being disposed spaced and parallel relative to each other;

a tail grabber connected to said frame for grabbing a tail end of the spent first roll;

a drive roll disposed downstream relative to said tail grabber for pulling the film through said tail grabber;

a registration device for registration of the tail end of the first roll with an aligned leading edge of the replacement second roll;

a splice head for splicing together the registered tail end and the leading edge such that the replacement roll is brought into operation without stopping the operation of bagging the snack foods;

said tail grabber including:

a first roller for guiding the tail end;

a second roller for guiding the tail end; and a clamp being movable from said first location thereof spaced from said first and second rollers to a second location thereof in which the tail end is clamped between said clamp and said first and second rollers such that limited movement of the tail end relative to said first and second rollers is permitted so that registration of the tail end is attainable.

2. A film splicer apparatus as set forth in claim 1 wherein said axes are disposed horizontally.

3. A film splicer apparatus as set forth in claim 1 wherein said tail grabber includes:

a first roller for guiding the tail end;

a clamp which is moveable from a first location thereof spaced from the first roller to a second location thereof in which the tail end is clamped between said clamp and said first roller such that limited movement of the tail end relative to said first roller is permitted so that registration of the tail end is attainable.

4. A film splicer apparatus as set forth in claim 1 wherein said tail grabber further includes:

a third roller disposed downstream relative to said first roller and upstream relative to said second roller, the arrangement being such that the tail end is guided around said first roller and is then guided around said third roller and is then guided back around said second roller so that the tail end follows a sinuous path.

5. A film splicer apparatus as set forth in claim 1 wherein said axle cooperates with a core of the first roll of the film;

said tail grabber is actuated in response to an absence of rotation of the core of the first roll of the film.

6. A film splicer apparatus as set forth in claim 5 wherein said tail grabber moves from said first location thereof to said second location thereof in response to said absence of rotation of the core of the first roll so that when the first roll of the film is spent, the empty core stops rotating;

a sensor for sensing said absence of rotation of the core of the first roll, said sensor generating a signal responsive to said sensed absence of rotation of the core of the first roll, said signal triggering actuation of said tail grabber so that said tail grabber moves to said second location thereof for slidably grabbing the tail end of the first roll of film.

7. A film splicer apparatus as set forth in claim 1 further including:

a backing roller which cooperates with said drive roll to define therebetween a nip for the passage therethrough of the film such that when said drive roll is driven, the film is pulled by an interaction of said drive roll and said backing roller until the tail end of the spent first roll is disposed in registration with and aligned relative to the leading edge of the replacement second roll.

8. A film splicer apparatus as set forth in claim 7 further including:

a festoon disposed downstream relative to said drive roll;

said drive roll pulling the film from the first roll and feeding the film into said festoon.

9. A film splicer apparatus as set forth in claim 8 further including:

a control system for controlling rotation of said drive roll;

said control system including:

a position encoder for monitoring a position of said festoon, said position encoder emitting a signal dependent on a position of said festoon, said signal controlling a rotational speed of said drive roll to fill a depleted festoon.

10. A film splicer apparatus as set forth in claim 9 further including:

a splice position tracking mechanism for tracking a position of a splice that has been generated at said splice head;

a tracking mechanism including:

a sensor for sensing a position of the splice and for alerting a downstream bagging station of the approach of such splice so that filling at a splice can be avoided.

11. A film splicer apparatus as set forth in claim 10 wherein said position encoder monitors a position of said festoon during said splicing so that determination of a distance traveled by said splice from said splicing to said bagging station is permitted.

12. A film splicer apparatus as set forth in claim 11 further including:

an encoder associated with said drive roll;

said tracking mechanism counting encoder pulses from said encoder of said drive roll to determine when said splice has traveled to said bagging station so that bagging of the snack foods can be inhibited such that wastage of snack foods can be minimized.

13. A film splicer apparatus as set forth in claim 1 wherein said registration device includes:

a first module;

said first module including:

a first guide roll;

a second guide roll disposed down stream relative to said first guide roll such that said guide rolls guide the tail end from said tail grabber;

a pivot for pivoting said first module relative to the leading edge of the replacement second roll.

14. A film splicer apparatus as set forth in claim 13 wherein said registration device further includes:

a second module;

said second module including:

a first guiding roll;

a second guiding roll disposed down stream relative to said first guiding roll such that said guiding rolls guide the leading edge from the second roll of film;

a further pivot for pivoting said second module relative to the tail end of the first roll of film, the arrangement being such that the leading edge of the replacement second roll is prepared by pivoting said second module away from the first roll of film and positioning the leading edge such that when said second module is pivoted back towards the first roll of film, the film of the first roll of film is disposed between said first module and said second module.

15. A film splicer apparatus as set forth in claim 1 wherein said splice head includes:

a heat sealing device for heat sealing the registered tail end of the first roll to the leading edge of the replacement second roll.

16. A film splicer apparatus as set forth in claim 15 wherein said heat sealing device is a lap splicer.

17. A film splicer apparatus as set forth in claim 16 wherein said heat sealing device includes:

a device for pressing the tail end against the leading edge when registered;

a heating element which is activated when the tail end and the leading edge are in registration relative to each other so that the tail end and the leading edge are fused together for sealing thereof;

said device releasing the spliced tail end and leading edge when cooled.

18. A film splicer apparatus as set forth in claim 15 wherein said splice head further includes:

a knife for cutting off a trailing end of the tail end of the first roll when the tail end has been sealed to the leading edge of the replacement second roll.

19. A film splicer apparatus for splicing a film used for bagging snack foods, said apparatus comprising:

a frame;

an axle supported by said frame for rotatably supporting a first roll of the film used for the bagging of the snack foods;

a further axle disposed spaced from said axle for rotatably supporting a replacement second roll of film for replacing the first roll of the film when spent, the first roll and the replacement second roll being rotatable about a first and second axis respectively, said axes being disposed spaced and parallel relative to each other;

a tail grabber connected to said frame for grabbing a tail end of the spent first roll;

a drive roll disposed downstream relative to said tail grabber for pulling the film through said tail grabber;

a registration device disposed downstream relative to said tail grabber for registration of the tail end of the first roll with an aligned leading edge of the replacement second roll;

a splice head for splicing together the registered tail end and the leading edge such that the replacement roll is brought into operation without stopping the operation of bagging the snack foods;

said axle cooperating with a core of the first roll of the film;

said axes being disposed horizontally;

said tail grabber including:

a first roller for guiding the tail end;

a second roller for guiding the tail end;

a clamp being movable from said first location thereof spaced from said first and second rollers to a second location thereof in which the tail end is clamped between said clamp and said first and second rollers such that limited movement of the tail end relative to said first and second rollers is permitted so that controlled registration of the tail end is attainable;

a third roller disposed downstream relative to said first roller and upstream relative to said second roller, the arrangement being such that the tail end is guided around said first roller and is then guided around said third roller and is then guided back around said second roller so that the tail end follows a sinuous path;

said axle cooperating with a core of the first roll of the film;

said tail grabber being actuated in response to an absence of rotation of the core of the first roll of the film;

said tail grabber moving from said first location thereof to said second location thereof in response to said absence of rotation of the core of the first roll so that when the first roll of the film is spent, the empty core stops rotating;

a sensor for sensing said absence of rotation of the core of the first roll, said sensor generating a signal responsive to said sensed absence of rotation of the core of the first roll, said signal triggering actuation of said tail grabber so that said tail grabber moves to said second location thereof for slidably grabbing the tail end of the first roll of film;

said registration device including:

a first module;

said first module including:

a first guide roll;

a second guide roll disposed down stream relative to said first guide roll such that said guide rolls guide the tail end from said tail grabber;

a pivot for pivoting said first module relative to the leading edge of the replacement second roll;

a second module;

said second module including:

a first guiding roll;

a second guiding roll disposed down steam relative to said first guiding roll such that said guiding rolls guide the leading edge from the second roll;

a further pivot for pivoting said second module relative to the tail end of the first roll, the arrangement being such that the leading edge of the replacement second roll is prepared by pivoting said second module away from the first roll and positioning the leading edge such that when said second module is pivoted back towards the first roll, the film of the first roll is disposed between said first module and said second module;

said splice head including:

a heat sealing device for heat sealing the registered tail end of the first roll to the leading edge of the replacement second roll;

said heat sealing device is a lap splicer;

said heat sealing device including:

a device for pressing the tail end against the leading edge when registered;

a heating element which is activated when the tail end and the leading edge are in registration relative to each other so that the tail end and the leading edge are fused together for sealing thereof;

said device releasing the spliced tail end and leading edge when cooled; and said splice head further including:

a knife for cutting off a trailing end of the tail end of the first roll when the tail end has been sealed to the leading edge of the replacement second roll.

20. A method of splicing a film used for bagging snack foods, said method comprising the steps of:

rotatably supporting a first roll of the film used for the bagging of the snack foods about a first axle rotatably supported by a frame;

rotatably supporting a replacement second roll of film for replacing the first roll of the film when spent, the first roll and the replacement second roll being rotatable about a first and second axis respectively, the axes being disposed spaced and parallel relative to each other;

grabbing a tail end of the spent first roll by a tail grabber connected to the frame;

pulling the film through the tail grabber by a driven drive roll disposed downstream relative to the tail grabber;

registering the tail end of the first roll with an aligned leading edge of the replacement second roll;

splicing together the registered tail end and the leading edge by a splice head such that the replacement roll is brought into operation without stopping the operation of bagging the snack foods;

guiding the tail end by a first roller of the tail grabber, the tail grabber including: the first roller, a second roller and a clamp, the clamp being movable from a first location thereof spaced from the first and second rollers to a second location thereof in which the tail end is clamped between the clamp and the first and second rollers such that limited movement of the tail end relative to the first and second rollers is permitted so that registration of the tail end is attainable; and moving the clamp from the first location thereof spaced from the fist roller and a second roller of the tail grabber to the second location thereof in which the tail end is clamped between the clamp and the first and second rollers such that limited movement of the tail end relative to the first and second rollers is permitted so that registration of the tail end is attainable.

* * * * *